US011598574B2

(12) United States Patent
Fulgham, Jr. et al.

(10) Patent No.: US 11,598,574 B2
(45) Date of Patent: Mar. 7, 2023

(54) APPLIANCE DOOR INCLUDING A WIRELESS MODULE

(71) Applicant: Electrolux Home Products, Inc., Charlotte, NC (US)

(72) Inventors: Cleo Rudolph Fulgham, Jr., Easley, SC (US); William T. Anniss, III, Simpsonville, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 64 days.

(21) Appl. No.: 17/206,698

(22) Filed: Mar. 19, 2021

(65) Prior Publication Data

US 2022/0299253 A1 Sep. 22, 2022

(51) Int. Cl.
*F25D 23/02* (2006.01)
*F25D 11/02* (2006.01)
*F25D 29/00* (2006.01)

(52) U.S. Cl.
CPC ..... *F25D 23/028* (2013.01); *F25D 11/02* (2013.01); *F25D 29/00* (2013.01); *F25D 2400/40* (2013.01)

(58) Field of Classification Search
CPC ..... F25D 23/028; F25D 11/02; F25D 29/00; F25D 2400/40
See application file for complete search history.

(56) References Cited

U.S. PATENT DOCUMENTS 6,739,144 B2 5/2004 Yun-Ho et al.
6,957,133 B1 * 10/2005 Hunt ..... B60R 25/302 701/32.7
7,032,405 B2 * 4/2006 Hwang ..... F25D 29/005 62/298
7,090,141 B2 8/2006 Roh et al.
7,266,963 B2 9/2007 Lee
7,520,758 B2 4/2009 Kim
8,042,346 B2 10/2011 Oh et al.
D674,823 S 1/2013 Jidam et al.
D686,254 S 7/2013 Wang et al.
8,526,935 B2 9/2013 Besore et al.
D692,033 S 10/2013 Choi et al.
D698,374 S 1/2014 Jeon et al.
(Continued)

FOREIGN PATENT DOCUMENTS

CN 1384326 12/2002
CN 110094930 8/2019
(Continued)

OTHER PUBLICATIONS

International Search Report for corresponding PCT/US2022/020582 dated Jun. 13, 2022, 2 pages.

*Primary Examiner* — Hanh V Tran
(74) *Attorney, Agent, or Firm* — Pearne & Gordon LLP

(57) ABSTRACT

An appliance door including an outer skin extending between first and second distal edges thereof, and an inner liner disposed adjacent the outer skin such that a space is formed therebetween. A first endcap is disposed at the first distal edge of the outer skin and the first endcap partially enclose the space formed between the outer skin and the liner. A wireless module is positioned on the first endcap and is configured to wirelessly communicate with a mobile device. The wireless module includes a printed circuit board and an antenna, wherein the antenna faces outwards and away from the first endcap.

16 Claims, 10 Drawing Sheets

(56) References Cited

U.S. PATENT DOCUMENTS

| | | | | |
|---|---|---|---|---|
| 9,528,748 | B2 * | 12/2016 | Joo | F25D 23/02 |
| 9,790,721 | B2 | 10/2017 | Ueyama | |
| 9,970,701 | B2 | 5/2018 | Jae et al. | |
| 9,970,704 | B2 | 5/2018 | Joo et al. | |
| 10,081,973 | B2 | 9/2018 | Ueyama | |
| 10,161,673 | B2 | 12/2018 | Yamato et al. | |
| 10,214,949 | B2 | 2/2019 | Ueyama | |
| 10,302,349 | B2 | 5/2019 | Park et al. | |
| 10,378,815 | B2 | 8/2019 | Lee et al. | |
| 10,429,126 | B2 * | 10/2019 | Park | F25D 23/028 |
| 10,524,586 | B2 * | 1/2020 | Oh | F25D 23/028 |
| 10,526,828 | B2 | 1/2020 | Ueyama | |
| 10,544,983 | B2 * | 1/2020 | Lee | F25D 29/005 |
| 10,619,911 | B2 | 4/2020 | Park et al. | |
| 10,684,065 | B2 | 6/2020 | Kim et al. | |
| 10,694,870 | B2 | 6/2020 | Oh et al. | |
| 10,907,884 | B1 * | 2/2021 | Scorsim | F25D 23/028 |
| 11,124,998 | B1 * | 9/2021 | Fazi | E05D 7/081 |
| 2005/0006997 | A1 * | 1/2005 | Yoshioka | F25D 23/02 312/405 |
| 2009/0193823 | A1 | 8/2009 | Lee | |
| 2011/0241847 | A1 * | 10/2011 | Baruco | B60R 25/245 340/12.5 |
| 2012/0073202 | A1 * | 3/2012 | Lee | F25D 29/005 49/70 |
| 2016/0116207 | A1 * | 4/2016 | Yamato | F25D 29/00 312/405 |
| 2016/0138857 | A1 * | 5/2016 | Klingshirn | F25D 29/00 62/130 |
| 2016/0341468 | A1 * | 11/2016 | Joo | F25D 11/02 |
| 2017/0188721 | A1 | 7/2017 | Park | |
| 2017/0370137 | A1 | 12/2017 | Ueyama | |
| 2018/0187951 | A1 * | 7/2018 | Seo | F25D 23/02 |
| 2018/0233806 | A1 * | 8/2018 | Yikilmazcinar | H01Q 1/24 |
| 2018/0292127 | A1 * | 10/2018 | Park | F25D 27/005 |
| 2018/0301785 | A1 * | 10/2018 | Yikilmazcinar | H01Q 5/371 |
| 2019/0120546 | A1 * | 4/2019 | Hong | F25D 11/00 |
| 2019/0271500 | A1 | 9/2019 | Lee et al. | |
| 2019/0316837 | A1 * | 10/2019 | Weber | G02B 6/0083 |
| 2019/0323768 | A1 | 10/2019 | Lee et al. | |
| 2020/0072544 | A1 * | 3/2020 | Lee | F25D 11/02 |
| 2020/0132357 | A1 | 4/2020 | Lee et al. | |
| 2020/0284503 | A1 * | 9/2020 | Gerstmayr | F25D 23/028 |
| 2020/0347641 | A1 * | 11/2020 | Chirumbolo | D06F 39/14 |
| 2021/0003337 | A1 * | 1/2021 | Voltarelli | F25D 25/025 |
| 2021/0055044 | A1 * | 2/2021 | Kraemer | F25D 17/04 |
| 2021/0102742 | A1 * | 4/2021 | Leidens | F25D 21/04 |
| 2021/0190406 | A1 * | 6/2021 | Seo | F25D 23/003 |
| 2022/0003028 | A1 * | 1/2022 | Chen | F25D 23/025 |

FOREIGN PATENT DOCUMENTS

| | | | | |
|---|---|---|---|---|
| EP | 2592371 | | 5/2013 | |
| EP | 3021062 | | 5/2016 | |
| EP | 3396282 | A2 * | 10/2018 | A47F 3/0434 |
| JP | H0560455 | | 3/1993 | |
| JP | H10332249 | | 12/1998 | |
| JP | 2009024921 | | 2/2009 | |
| JP | 5087443 | | 10/2009 | |
| KR | 200319651 | | 7/2003 | |
| KR | 20050119468 | | 12/2005 | |
| WO | 2017029782 | | 2/2017 | |
| WO | 2021024292 | | 2/2021 | |

* cited by examiner

APPLIANCE DOOR INCLUDING A WIRELESS MODULE

FIELD OF THE INVENTION

This application relates generally to a refrigerator appliance door, and more particularly, an appliance door including an endcap at a distal edge thereof, wherein a wireless module is disposed on the endcap, and wherein the wireless module is configured to wirelessly communicate with a mobile device.

BACKGROUND OF THE INVENTION

Conventional appliances, including refrigeration appliances, can be connected to a remote computer server, often referred to as a 'cloud server' or simply the 'cloud,' which is then connected to a remote mobile device to thereby provide electronic data communication and control capabilities between an end user and the refrigerator appliance from remote locations of the end user. The refrigerator appliance is generally connected to the 'cloud' via a wireless module. Conventionally, such wireless modules are positioned within a cabinet of the refrigerator appliance or even on an external surface of the cabinet.

Placing the wireless module within the cabinet generally results in smaller possible connective ranges for wireless data transmission and reception due to the various obstructions surrounding the wireless module. Moreover, such placement can make installation or repair servicing of the wireless module difficult, as various elements must be removed (by specific tools) before gaining access to the wireless module. Additionally, because the cabinet is typically made of metal, placing the wireless module within the cabinet, or even on an external surface thereof diminishes wireless data transmission and reception connectivity.

BRIEF SUMMARY OF THE INVENTION

In accordance with one aspect, there is provided a refrigerator appliance door comprising an outer skin extending between first and second distal edges thereof. The outer skin forms an external appearance of the refrigerator appliance door. An inner liner is disposed adjacent the outer skin such that a space is formed therebetween. A first endcap is disposed at the first distal edge of the outer skin. The first endcap partially encloses the space formed between the outer skin and the inner liner. The refrigerator appliance door further includes a wireless module configured to wirelessly communicate with a mobile device. The wireless module is positioned on the first endcap.

In accordance with another aspect, there is provided an appliance comprising a cabinet defining a compartment for storing food items in a cooled environment. A door is pivotably attached to the cabinet to provide selective access to the compartment. The door comprises an endcap disposed adjacent a top wall of the cabinet when the door is in a closed position. The door further includes a wireless module configured to wirelessly communicate with a mobile device. The wireless module is positioned on the endcap and includes a printed circuit board and an antenna. The antenna faces outwards and away from the endcap.

In accordance with yet a further aspect, there is provided a refrigerator appliance door that is pivotably attached to a cabinet of a refrigerator appliance to provide selective access to a compartment thereof. The refrigerator appliance door includes an outer skin extending between first and second distal edges thereof. The outer skin forms an external appearance of the refrigerator appliance door, and the first distal edge of the outer skin is disposed adjacent a top wall of the cabinet when the refrigerator appliance door is in a closed position. An inner liner is disposed adjacent the outer skin such that a space is formed therebetween. A first endcap is disposed at the first distal edge of the outer skin and is made of plastic and comprises first and second pockets, each recessed from a top wall of the first endcap. The first and second pockets are spaced from one another by a boundary and are arranged side-by-side with respect to a longitudinal direction of the first endcap. The first pocket is defined by a bottom wall and a peripheral wall. A locating pin extends from the bottom wall and includes a base and a shaft, wherein a retention clip extends from the bottom wall and includes a distal end that is resiliently movable. The first pocket is configured to accept a hinge therein to permit the refrigerator appliance door to pivot.

The refrigerator appliance door further includes a second endcap disposed at the second distal edge of the outer skin. The second endcap is made of plastic. The first and second endcaps collectively enclose the space formed between the outer skin and the inner liner. The refrigerator appliance door also includes a wireless module configured to wirelessly communicate with a mobile device. The wireless module comprises a printed circuit board having opposite first and second surfaces, and an antenna disposed on the first surface of the printed circuit board. The wireless module is received within the first pocket such that the second surface of the printed circuit board rests on a ledge of the base and such that the shaft extends through a locating hole formed in the printed circuit board. Further, the distal end of the retention clip contacts the first surface of the printed circuit board. A cover is received within the first pocket and is arranged to conceal the wireless module. The cover comprises a top wall that is coplanar with the top wall of the first endcap. The cover has a securing clip extending outwards from the top wall thereof. The securing clip is configured to engage with a corresponding tab protruding from the peripheral wall of the first pocket in order to secure the cover to the first endcap.

DESCRIPTION OF EXAMPLE EMBODIMENTS

Figure 1:
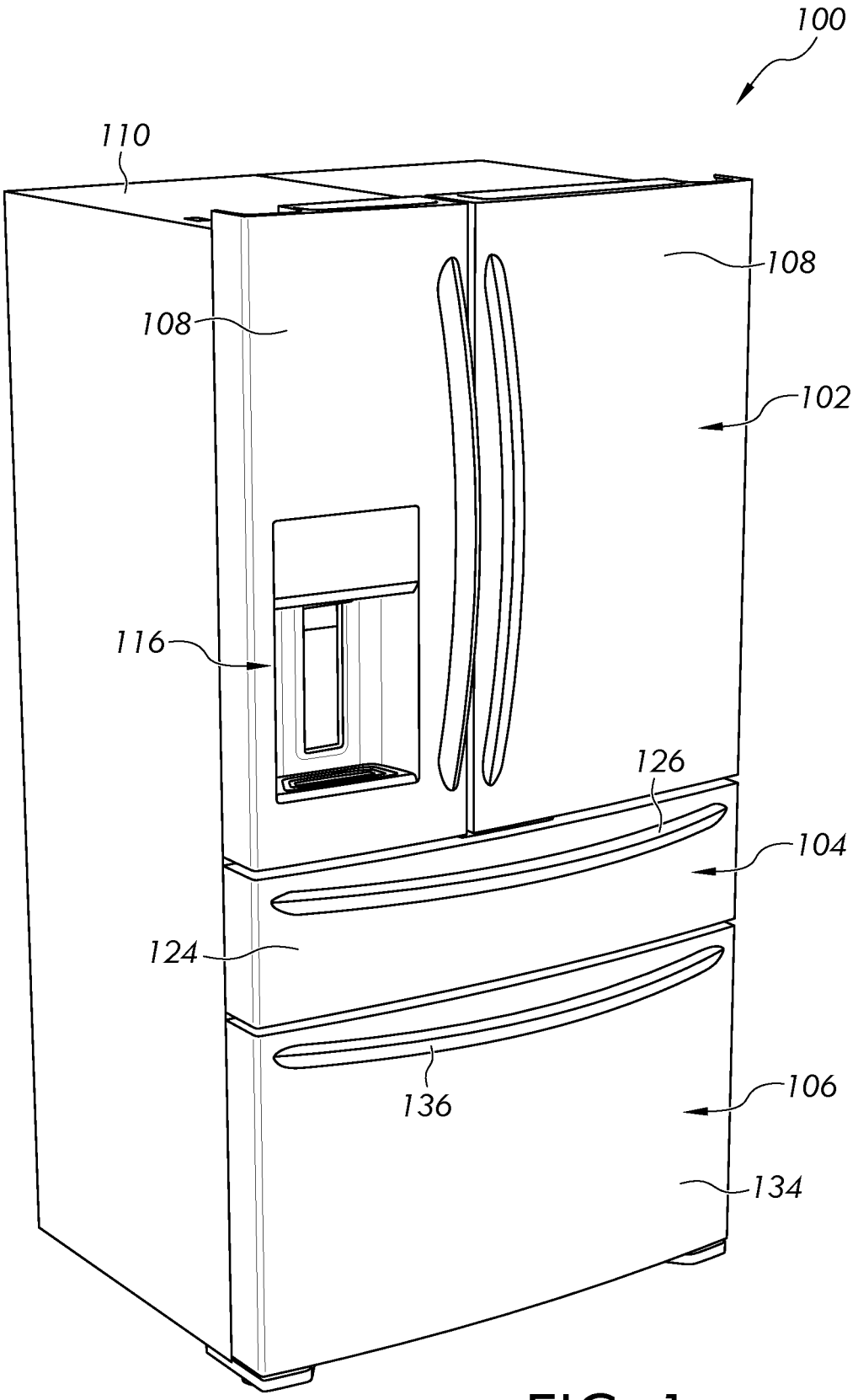
FIG. 1 is a front perspective view of a household French Door Bottom Mount refrigerator showing doors of a fresh-food compartment and drawers of a freezer compartment and a variable climate zone compartment in a closed position.

Referring now to the drawings, FIG. 1 shows a refrigeration appliance in the form of a domestic refrigerator, indicated generally at 100. Although the detailed description that follows concerns a domestic refrigerator 100, the invention can be embodied by refrigeration appliances other than a domestic refrigerator 100. For example, the wireless module (discussed below) can be embodied in various other appliances that utilize a door or other external feature with an end cap, such as an oven or range, dishwasher, microwave, refrigerator, freezer, ice maker, compactor, dehumidifier, air conditioner, etc. Further, an embodiment is described in detail below, and shown in the figures as a bottom-mount configuration of a refrigerator 100, including a fresh-food compartment 102 disposed vertically above a variable climate zone (VCZ) compartment 104 and a freezer compartment 106. Still, it is to be understood that the refrigerator can have any desired configuration including at least a fresh food compartment and/or a freezer compartment, such as a top mount refrigerator (freezer disposed above the fresh food compartment), a side-by-side refrigerator (fresh food compartment is laterally next to the freezer compartment), a standalone refrigerator or freezer, etc.

Two fresh-food compartment doors 108 shown in FIG. 1 are pivotably coupled to a cabinet 110 of the refrigerator 100 to selectively restrict and grant access to the fresh-food compartment 102. As shown, the fresh-food compartment doors 108 are French-type doors that collectively span the entire lateral distance of the entrance of the fresh-food compartment 102 to enclose the fresh-food compartment 102.

A center flip mullion 112 (shown in FIG. 2) is pivotally coupled to at least one of the fresh-food compartment doors 108 at a location between opposing side surfaces 114 (shown in FIG. 2) of said fresh-food compartment doors 108. The mullion 112 can be pivotally coupled to the fresh-food compartment door 108 to pivot between a first orientation that is substantially parallel to a planar surface of the fresh-food compartment door 108 when the fresh-food compartment door 108 is closed, and a different, second orientation when the fresh-food compartment door 108 is opened. The externally-exposed surface of the mullion 112 is substantially parallel to the fresh-food compartment door 108 when the mullion 112 is in the first orientation, and forms an angle other than parallel relative to the fresh-food compartment door 108 when the mullion 112 is in the second orientation. In the embodiment shown in FIG. 1, the seal and the externally-exposed surface of the mullion 112 cooperate at a position offset from a centerline midway between the lateral sides of the fresh-food compartment 102. However, it is contemplated that the seal and the externally-exposed surface of the mullion 112 can cooperate approximately midway between the lateral sides of the fresh-food compartment 102.

As shown in FIG. 1, a dispenser 116 for dispensing at least ice pieces, and optionally water, can be provided on one of the fresh-food compartment doors 108. The dispenser 116 can include a lever, switch, proximity sensor or other device that a user can interact with to cause frozen ice pieces to be dispensed from an ice bin (not shown) of an ice maker 118 (shown in FIG. 2) disposed within the fresh-food compartment 102.

The fresh-food compartment 102 serves to minimize spoiling of articles of food stored therein. This is accomplished by maintaining the temperature in the fresh-food compartment 102 at a cool temperature that is typically above 0° C., so as not to freeze the articles of food in the fresh-food compartment 102. It is contemplated that the cool temperature is a user-selectable target fresh-food temperature preferably between 0° C. and 10° C., more preferably between 0° C. and 5° C. and even more preferably between 0.25° C. and 4.5° C. A fresh-food evaporator (not shown) is dedicated to separately maintaining the temperature within the fresh-food compartment 102 independent of the freezer compartment 106.

Figure 2:
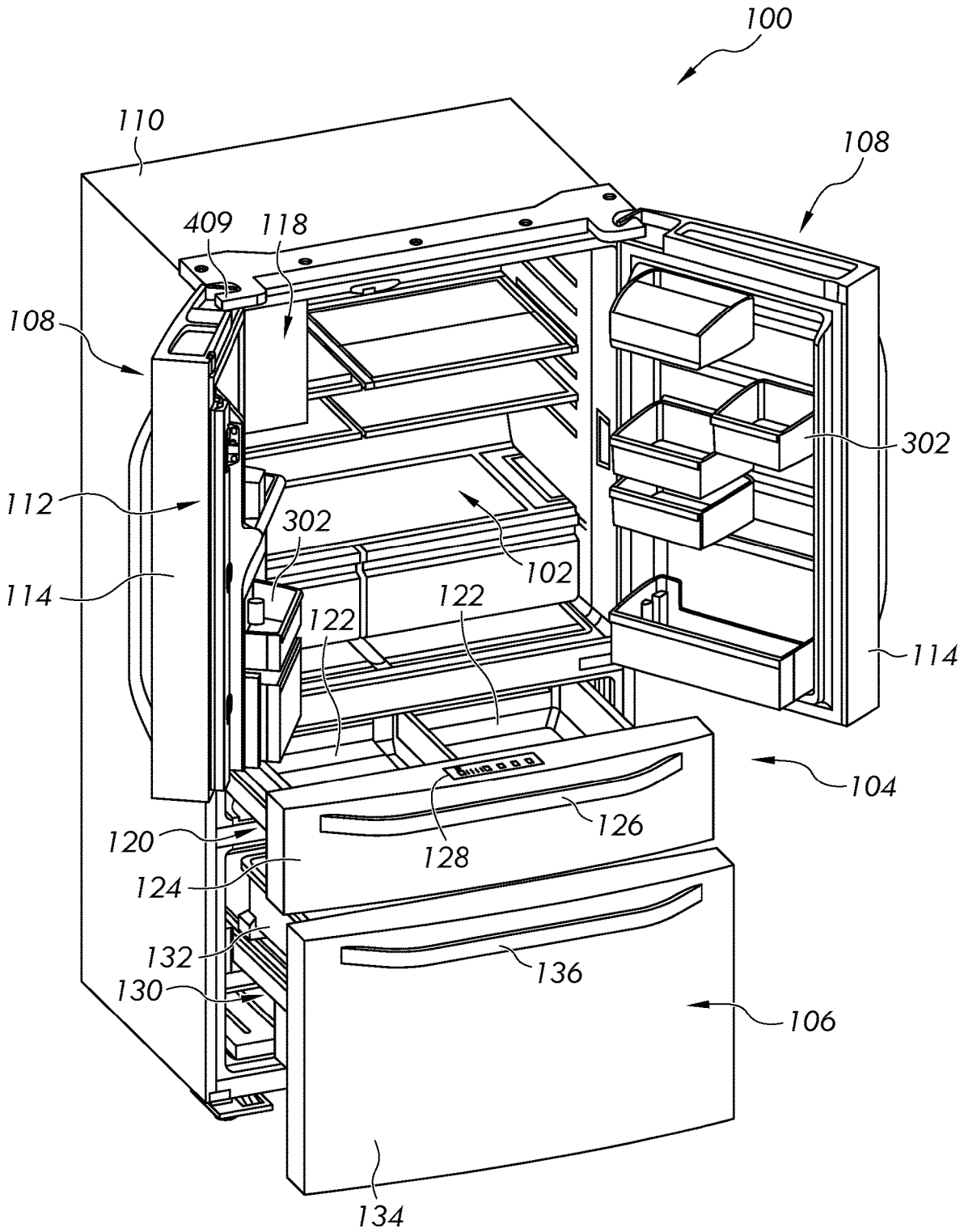
FIG. 2 is a front perspective view of the refrigerator shown in FIG. 1 showing the doors of the fresh-food compartment and the drawers of the freezer compartment and the variable climate zone compartment in an opened position.

As best shown in FIG. 2, the VCZ compartment 104 is disposed between the fresh-food compartment 102 and the freezer compartment 106 and is configured to operate at different user-selectable temperatures with respect to the fresh-food compartment 102 and/or the freezer compartment 106. A VCZ drawer assembly 120 is positioned in the VCZ compartment 104 and includes a basket or tray 122 for storing food items thereon. The VCZ drawer assembly 120 can be withdrawn from the VCZ compartment 104 to grant a user access to the food items. The VCZ drawer assembly 120 includes a door 124 having a handle 126 attached thereto. When a user grasps the handle 126 and pulls the door 124, the basket or tray 122 is caused to be at least partially withdrawn from the VCZ compartment 104.

A control unit or user interface 128 is disposed on an upper portion of the door 124. The user interface 128 is positioned such that it is not visible when the VCZ drawer assembly 120 is in a closed position (as shown in FIG. 1). The user interface 128 is accessible when the door 124 of the VCZ compartment 104 is extended from the refrigerator 100. The user interface 128 is configured to allow a user the ability to selectively operate the VCZ compartment 104 at a user-selectable target variable climate zone temperature between a predetermined temperature below 0° C. and a predetermined temperature above 0° C., including both true fresh-food and freezing temperatures, for example, −18° C., −12° C., −2 C, 0° C. and +4° C. It is contemplated that the user interface 128 may be a plurality of push buttons, a touch display screen, a keyboard or any conventional device for allowing a user to input commands to a control system (not shown) of the refrigerator 100.

As further shown in FIG. 2, the freezer compartment 106 is arranged vertically beneath the VCZ compartment 104. A freezer drawer assembly 130 including one or more freezer baskets 132 can be withdrawn from the freezer compartment 106 to grant a user access to food items stored therein. The freezer drawer assembly 130 can be coupled to a freezer door 134 that includes a handle 136. When a user grasps the handle 136 and pulls the freezer door 134 open, at least one or more of the freezer baskets 132 is caused to be at least partially withdrawn from the freezer compartment 106.

The freezer compartment 106 is used to freeze and/or maintain articles of food stored therein in a frozen condition. For this purpose, the freezer compartment 106 includes a freezer evaporator (not shown) that removes thermal energy from the freezer compartment 106 to maintain the temperature therein at a user-selectable target freezer temperature, e.g., a temperature of 0° C. or less during operation of the refrigerator 100, preferably between 0° C. and −50° C., more preferably between 0° C. and −30° C. and even more preferably between 0° C. and −20° C. The freezer compartment 106 is also in communication with the VCZ compartment 104 such that a portion of the cooling air supplied by the freezer evaporator (not shown) may be selectively supplied to the VCZ compartment 104.

Figure 3:
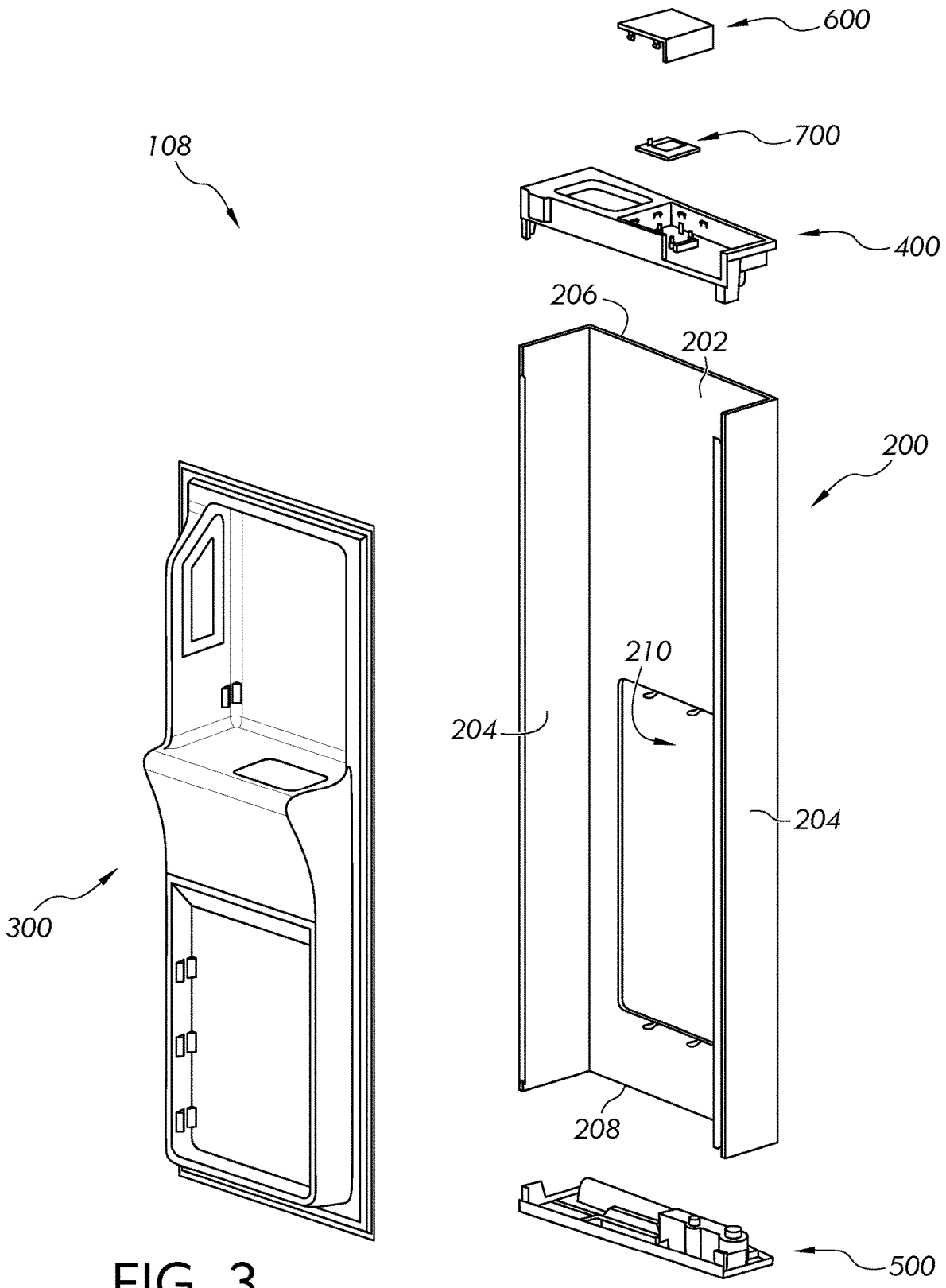
FIG. 3 is an exploded view of select features of one of the fresh-food compartment doors shown in FIG. 2, including top and bottom endcaps, an outer skin, an inner liner, a wireless module, and a cover.

Now moving on to FIG. 3, select features of one of the fresh-food compartment doors 108 is shown in an exploded, rear view. Of note, while the below-disclosures are directed towards only one of the fresh-food compartment doors 108, it is contemplated that the below-disclosures could likewise apply to the other fresh-food compartment door 108, or other similar doors or exterior structures of other appliances in which the wireless module may be used.

As shown, the fresh-food compartment door 108 comprises an outer skin 200, an inner liner 300, a first (top) endcap 400, a second (bottom) endcap 500, a cover 600, and a wireless module 700. The outer skin 200 is a plate-like member, bent to form an external appearance of the fresh-food compartment door 108. The outer skin 200 includes a front panel 202 and opposing side panels 204 extending (rearwardly) away therefrom. The front panel 202 and the side panels 204 can all be formed integrally (i.e., from a single material, such as metal) during a single manufacturing process to form a planar, plate-like member, wherein the side panels 204 are subsequently bent away from the front panel 202. However, it is contemplated that the front panel 202 and the side panels 204 can be formed separate and distinct from one another and subsequently secured together.

The outer skin 200 extends between a first (top) distal edge 206 and a second (bottom) distal edge 208. The distance between the first distal edge 206 and the second distal edge 208 of the outer skin 200 is equal to or greater than a corresponding vertical distance of the cabinet opening providing access into the fresh-food compartment 102. That is, the first distal edge 206 of the outer skin 200 is generally disposed adjacent a top wall of the cabinet 110 (shown in FIG. 1). As further shown, a through-hole 210 is formed in the front panel 202 and corresponds to an installed location of the dispenser 116 (shown in FIG. 1).

The inner liner 300 is sized and shaped to be received by respective edges of the side panels 204 of the outer skin 200. That is, in an installed position, the inner liner 300 extends generally parallel to the front panel 202 such that the inner liner 300 extends (in a vertical direction) between the first and second distal edges 206, 208, and is spaced from the front panel 202 via the side panels 204. Accordingly, when the inner liner 300 is secured to the outer skin 200, a space is formed therebetween. Typically, the inner liner 300 is made of a molded plastic material.

The inner liner 300 faces the fresh-food compartment 102 when the fresh-food compartment door 108 is in a closed position (shown in FIG. 1). Further, as shown best in FIG. 2, the inner liner 300 may have storage bins 302 (removably) secured thereto for storing food items on the fresh-food compartment door 108 and within the fresh-food compartment 102, when the fresh-food compartment door 108 is in the closed position.

The first and second endcaps 400, 500 are configured to engage with respective hinges (attached to the cabinet 110) such that the fresh-food compartment door 108 is pivotably secured to the cabinet 110 between its opened and closed positions. More specifically, as will be further discussed below, the first endcap 400 is configured to accept and engage with a hinge 409 (shown in FIG. 2). Further, as will be discussed in greater detail below, the first and second endcaps 400, 500 are configured to be secured adjacent the first and second distal edges, respectively, of the outer skin 200 to thereby enclose the space formed between the outer skin 200 and the inner liner 300.

Figure 4:
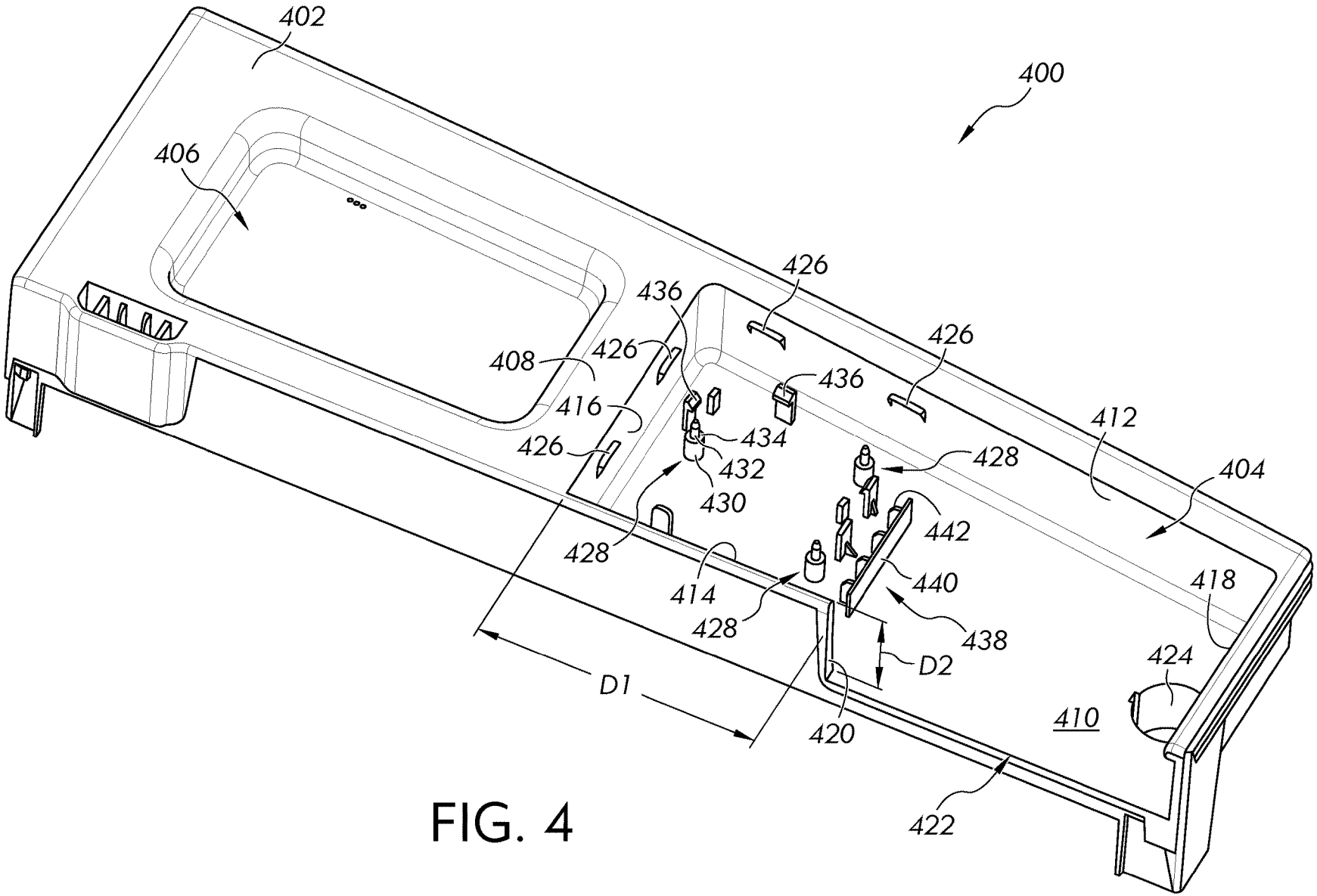
FIG. 4 is a perspective view of the top endcap shown in FIG. 3.

Now moving on to FIG. 4, the first endcap 400 is shown in a (rear) perspective view. The first endcap 400 includes a top wall 402 having first and second pockets 404, 406 recessed therefrom. In an assembled state (shown in FIG. 2), the top wall 402 of the first endcap 400 is a top-most surface of the fresh-food compartment door 108 and is substantially unobstructed from above. That is, there are no elements disposed vertically above the first endcap 400 that would substantially cover it. Moreover, the first endcap 400 is manufactured from plastic that is effectively transparent to electromagnetic radio waves used in the wireless module 700. However, it is contemplated that the first endcap 400 may be manufactured from other materials that similarly will not obstruct the performance of the wireless module 700.

As mentioned above, the first and second pockets 404, 406 are recessed from the top wall 402 of the first endcap 400. More specifically, the first and second pockets 404, 406 are formed in (i.e., integral during a single manufacturing process with) the first endcap 400. However, it is contemplated that the first and/or second pockets 404, 406 may be formed separate and distinct from the first endcap 400 and subsequently secured thereto. The first and second pockets 404, 406 are recessed from the top wall 402 such that they each extend away from the top wall 402 (i.e., in a vertically downward direction), and are spatially separated from one another via a boundary 408. The first pocket 404 may be considered a hinge pocket, wherein the first pocket 404 is configured to accept various elements of the hinge 409 (shown in FIG. 2). The second pocket 406, which is optional, can be utilized as a pocket handle that enables a user's fingers to grasp the top surface of the fresh-food compartment door 108 and thereby pull the door to an open position. It is also contemplated that the first endcap 400 could be formed with a single pocket that extends over a majority of the upper surface, in which the first and second pockets 404, 406 are effectively a single pocket without the boundary 408.

As further shown in FIG. 4, the first pocket 404 is defined by a bottom wall 410 and a peripheral wall, including opposite first and second walls 412, 414 that are spaced apart from one another via opposite third and fourth walls 416, 418. In an installed position, the first (front) wall 412 is disposed along the front panel 202 of the outer skin 200 and the second (rear) wall 414 is spaced therefrom such that it is disposed adjacent the inner liner 300. Further, the third (side) wall 416 is a surface of the boundary 408 and extends between the first and second walls 412, 414, whereas the fourth (side) wall 418 is disposed adjacent one of the side panels 204 (in an installed position) and extends from the first wall 412 in a direction outwards and away therefrom. The first, second, third, and fourth walls 412, 414, 416, 418 all extend from the bottom wall 410 in an outwards (i.e., upwards) direction in a substantially perpendicular manner.

As depicted, the second wall 414 does not extend completely between the third wall 416 and the fourth wall 418. Rather, the second wall 414 extends from the third wall 416 to an edge 420 such that a gap 422 is disposed between the edge 420 of the third wall 416 and the fourth wall 418. The gap 422 is configured to permit the hinge 409 (shown in FIG. 2) entry into the first pocket 404 in order to engage a hinge-hole 424 (i.e., a through-hole) formed in the bottom wall 410. Moreover, the second wall 414 extends from the third wall 416 to the edge 420 by a first distance D1, and a depth of the first pocket 404 (i.e., a distance between the top wall 402 and the bottom wall 410) is equal to a second distance D2. It is to be appreciated that these distances (i.e., the first and second distances D1, D2) can be determined by the shape, size, and/or operation of the door hinge hardware.

At least one tab 426 (i.e., a protrusion) extends outwards from the peripheral wall and into the first pocket 404. More specifically, FIG. 4 depicts a plurality of tabs 426 spaced (one from the other) along the first wall 412 and the third wall 416 of the first pocket 404 (however tabs 426 likewise extend along the second wall 414). It is to be understood that any number of tabs 426 may project from any one of the first, second, and/or third walls 412, 414, 416. As will be further explained below, the tabs 426 are configured to locate and/or secure the cover 600 to the first endcap 400.

As further show, a locating pin 428 is positioned on the bottom wall 410 and extends vertically outwards therefrom and into the first pocket 404. While FIG. 4 depicts a total of three locating pins 428, it is to be understood that at least one or any number of locating pins 428 may be used. Each locating pin 428 includes a base 430 and a shaft 432. The base 430 extends directly from the bottom wall 410 and has a cylindrical shape. The shaft 432 extends outwards from the base 430 and likewise has a generally cylindrical shape. A width (i.e., diameter) of the base 430 is greater than a width (i.e., diameter) of the shaft 432 such that a ledge 434 of the base 430 supports the wireless module 700 thereon, as will be further discussed below. It is to be understood that the base 430 and/or the shaft 432 can have a shape other than cylindrical (e.g., cube, etc.). It is further contemplated that the shaft 432 may not include any base 430, but may instead extend fully to the bottom wall 410.

Figure 7:
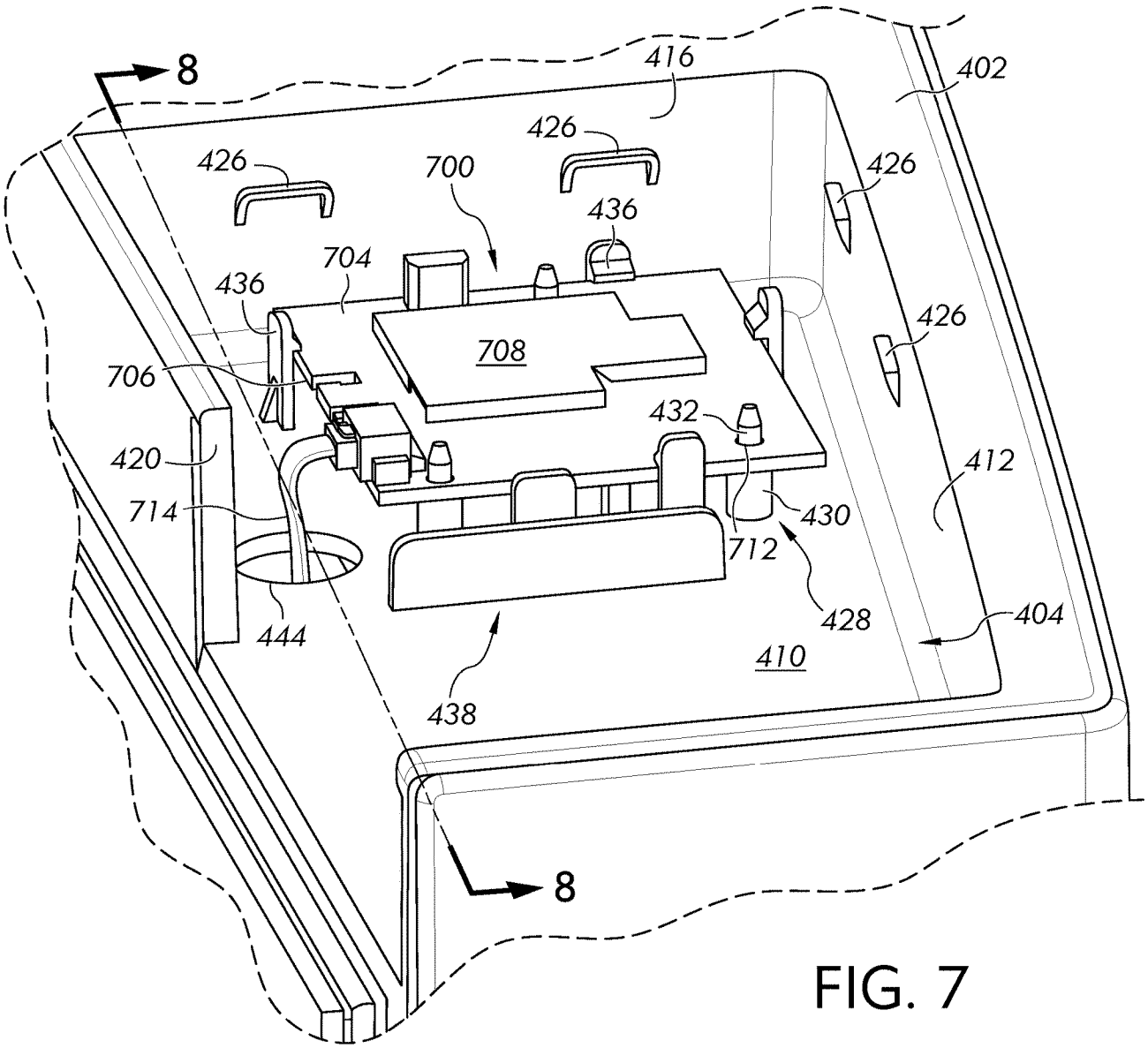
FIG. 7 is a perspective view of the wireless module secured to the top endcap.

Further, a retention clip 436 is disposed on the bottom wall 410 and extends vertically outwards therefrom and into the first pocket 404. The retention clip 436 is a resilient member wherein a distal end thereof is capable of movement (in short distances). While FIG. 4 depicts multiple retention clips 436, it is to be understood that any number of retention clips 436 may be used. As will be further discussed below, the retention clips 436 are configured to secure the wireless module 700 to the first endcap 400. Preferably, the retention clips 436 have an enlarged hook end for interacting with or capturing the wireless module 700. In this manner, the retention clips 436 are spaced about an outer periphery of the wireless module 700 (e.g., as shown in FIG. 7).

A securing member 438 also is disposed on the bottom wall 410 and extends vertically outwards therefrom and into the first pocket 404. The securing member 438 includes an upstanding wall 440 and a fin 442 extending laterally outward from a surface of the upstanding wall 440. Specifically, FIG. 4 depicts a plurality of fins 442 that are spaced apart, one from the other, in a direction parallel to a longitudinal direction of the upstanding wall 440. As will be further discussed below, the securing member 438 provides further support to the cover 600 in order to secure the cover 600 to the first endcap 400. Moreover, an access hole 444 (i.e., a through-hole) is formed in the bottom wall 410 of the first pocket 404 (as shown in FIG. 7). The access hole 444 is configured to permit an electrical wire 714 to be routed from the interior door space formed between the outer skin 200 and the inner liner 300 and into the first pocket 404, as will be discussed further below.

Figure 5:
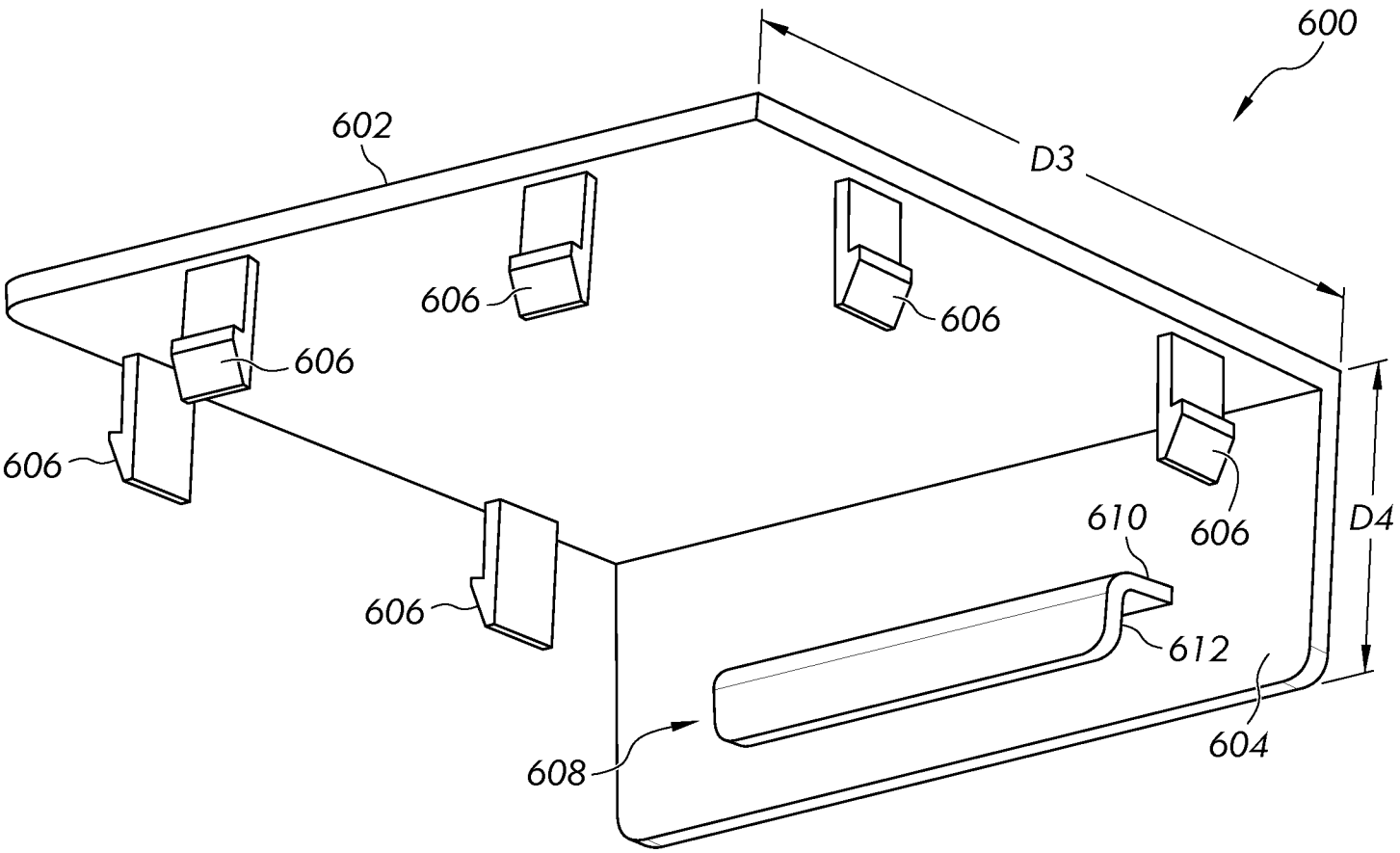
FIG. 5 is a perspective view of the cover shown in FIG. 3.

Now moving on to FIG. 5, one example cover 600 is shown in a bottom-rear, perspective view. Although one example is described below, it is to be appreciated that the cover 600 can have various geometries that correspond to the first pocket 404 and wireless module 700. The cover 600 is an L-shaped member including a top wall 602 and a side wall 604 extending (perpendicularly) away therefrom. The top wall 602 and the side wall 604 are formed integrally (i.e., from a single material, such as plastic, during a single manufacturing process). Alternatively, it is contemplated that the top wall 602 and the side wall 604 can be formed separate and distinct from one another and subsequently secured together. Moreover, the top wall 602 extends a third distance D3, in a direction from the side wall 604 towards an opposing, distal edge thereof of the top wall 602. Also, the side wall extends a fourth distance D4, in direction from the top wall 602 to an opposing, distal edge of the side wall 604. As will be further discussed below, in one embodiment the third distance D3 (i.e., the distance that the top wall 602 spans) corresponds to the first distance D1 (i.e., the distance that the second wall 414 of the first pocket 404 spans), and the fourth distance D4 (i.e., the distance that the side wall 604 spans) corresponds to the second distance D2 (i.e., the depth) of the first pocket 404.

Securing clips 606 extend outwards and away from the top wall 602 in the same general direction that the side wall 604 extends away from the top wall 602. While FIG. 5 depicts a total of six securing clips 606, it is to be understood that any number of securing clips 606 may be used. The securing clips 606 are resilient members wherein a distal end of each securing clip 606 is capable of movement (in short distances). As will be further discussed below, the securing clips 606 are configured to engage with the overhanging tabs 426 on the peripheral wall of the first pocket 404 to thereby secure the cover 600 to the first endcap 400 in a snap-fit manner. Accordingly, it is to be understood that the securing clips 606 are provided at spaced locations that correspond to respective locations of corresponding tabs 426.

As further shown in FIG. 5, the cover 600 includes a claw 608 extending outwards from a surface of the side wall 604 and located beneath the top wall 602. The claw 608 includes integrally formed first and second legs 610, 612 that together form an L-shaped member, protruding from the side wall 604. Specifically, the first leg 610 projects outwards from the side wall 604 and extends in a generally parallel manner with respect to the top wall 602, whereas the second leg 612 projects outwards from the first leg 610 (in a perpendicular manner) such that the second leg 612 extends in a generally parallel manner with respect to the side wall 604 (in a direction away from the top wall 602). As will be further discussed below, the claw 608 is configured to engage the securing member 438 within the first pocket 404 to secure the cover 600 to the first endcap 400.

Figure 6:
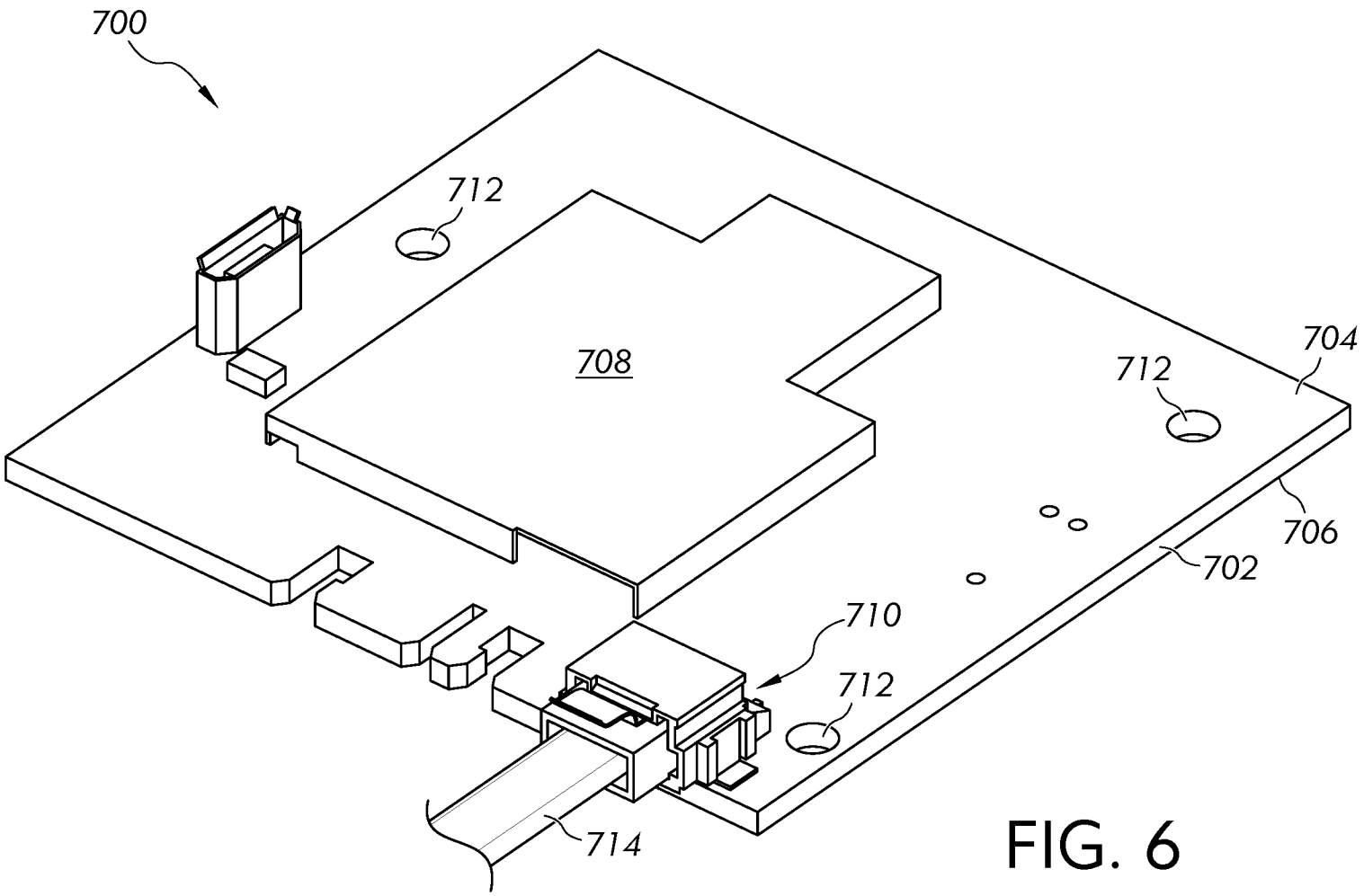
FIG. 6 is a perspective view of the wireless module shown in FIG. 3.

Now with reference to FIG. 6, the wireless module 700 is shown schematically in a perspective view. The wireless module 700 includes a printed circuit board 702 having opposite first and second surfaces 704, 706. An antenna 708 and an electrical connector 710 are positioned on the first surface 704, at spaced locations with respect to one another. As further shown, a plurality of locating holes 712 (i.e., through-holes) are formed in the printed circuit board 702 at locations associated with corresponding locating pins 428, as will be further discussed below.

The wireless module 700 functions as a transceiver, capable of both transmitting and receiving information wirelessly through a transmission medium. For example, the wireless module 700 may be configured to transmit/receive information through transmission mediums including, but not limited to, WiFi, Bluetooth, Zigbee, etc. In one example, the wireless module 700 is configured to transmit via one of the IEEE WiFi 802.11 band standards at a frequency of 2.4-2.5 Ghz or 5 Ghz. More specifically, the wireless module 700 shares a communication bus (not shown) with a user interface (not shown) and/or with a main control board (not shown) of the refrigerator 100. That is, the wireless module 700 communicates with an internal communication bus of the refrigerator 100, preferably to a main control board, that sends/receives information to a remote computer server, referred to herein as a cloud server. Of note, the communication between the wireless module 700 and the internal communication bus can be achieved via a wired connection that will run through the door and into the cabinet by the door hinge, or even a wireless connection. An end user may access the cloud server via a mobile application installed on a remote mobile device that is not physically connected to the appliance including, but not limited to, mobile phones, tablets, computers/laptops, smart-devices, etc. In this manner, communication and control capabilities are provided between the end user and the refrigerator 100 from remote locations of the user. For example, the end user may remotely control the temperature of any one of the dedicated compartments (e.g., fresh-food compartment 102, VCZ compartment 104, freezer compartment 106), control ice-making operations of the ice maker 118, and other functions associated with the refrigerator 100. To accomplish the remote control, the user can transmit a command from their mobile device to the cloud server, which in turn will then communicate the command to the appliance. Moreover, the end user may receive notifications from the refrigerator (e.g., conclusion of ice-making operations, expiration of water filter(s), alarms, alerts, etc.). Two-way communication between the appliance and the mobile device can occur in like manners via the intermediary cloud server. Further still, the refrigerator 100 is capable of wirelessly transmitting technical information (e.g., status of refrigerator elements) to improve technical support during servicing/repair. It is contemplated that the wireless module 700 can be configured for direct wireless communication with the mobile device without relying upon the cloud server being an intermediary device.

As the wireless module 700 wirelessly transmits/receives information over a transmission medium (via a communication bus), it is important to position the wireless module 700 at a location in/on the refrigerator 100 that is not overly obstructive in order to ensure proper connectivity and increased range of wireless communication. Further, it is important to place the wireless module 700 at a location where surrounding elements thereof are not made of a material (e.g., metal) that would negatively affect the functionality of the wireless module 700. Additionally, it is beneficial for the wireless module 700 to be outwardly accessible with respect to the refrigerator 100 in order to permit efficient service/replacement thereof.

Reference will now be made to assembly of the fresh-food compartment door 108. Of note, it is to be understood that the below steps are only an example of the assembly process. That is, assembly may be accomplished with additional or fewer steps, and/or in a sequential order that differs from the order described below.

Briefly moving back to FIG. 3, the first and second endcaps 400, 500 are secured to the first and second distal edges 206, 208 of the outer skin 200, respectively (e.g., via a compression engagement or clip-tab engagement, not shown). Next, moving on to FIG. 7, the wireless module 700 is positioned within the first pocket 404, and more particularly, seated on the locating pins 428. This is accomplished by placing the wireless module 700 above the first pocket 404 and aligning each of the locating holes 712 (shown best in FIG. 6) with a designated one of the locating pins 428. Thereafter, the wireless module 700 is installed on the locating pins 428 such that the second surface 706 of the printed circuit board 702 physically rests on the ledges 434 (shown in FIG. 4) of the locating pins 428. In this manner, the respective shafts 432 of the locating pins 428 extend through corresponding locating holes 712 of the printed circuit board 702, thus securing the wireless module 700 against lateral shifting. Preferably, the location of the various shafts 432 (and corresponding locating holes 712 of the printed circuit board 702) are asymmetrically arranged upon the first endcap 400 so that the printed circuit board 702 can only be located in a single location and orientation on the first endcap 400. More preferably, this single mounting arrangement will ensure that the position of the antenna 708 faces upwards.

Further, during assembly of the wireless module 700, distal ends of respective retention clips 436 are laterally shifted out of the way to permit the wireless module 700 to be seated on the locating pins 428. This can be accomplished by a user personally moving each of the distal ends of the retention clips 436, or by simply sliding the wireless module 700 into place and thus permitting the peripheral edges of the printed circuit board 702 to displace the distal ends of the retention clips 436 to provide the necessary clearance. After the wireless module 700 is correctly seated on the locating pins 428, the retention clips 436 spring back to their original placement (via an inherent biasing force) such that the distal ends of each retention clip 436 is disposed above the first surface 704 of the printed circuit board 702. Further still, the distal ends of each retention clip 436 may physically contact the first surface 704 of the printed circuit board 702 to ensure proper securement within the first pocket 404 (i.e., the wireless module 700 is secured against vertical movement).

Accordingly, the design of the first endcap 400 permits the wireless module 700 to be installed within the first pocket 404 in a relatively simple and tool-less manner. Additional screws and/or complex securing members are not necessary to ensure proper securement of the wireless module 700 within the first pocket 404, although optionally could be used. Rather, the locating pins 428 are configured and spaced to provide only a single installed orientation of the wireless module 700, and installation can be accomplished by simply dropping the wireless module 700 into seated engagement with the locating pins 428 (e.g., either by manual/user operation, or by automation). Also, the retention clips 436 ensure that the wireless module 700 continuously remains in the installed position. Further, this design provides efficient removal of the wireless module 700 from the first pocket 404 in the event that service work is necessary. That is, the respective distal ends of the retention clips 436 only need to be laterally shifted (i.e., away from the wireless module 700) in order to permit the necessary clearance for removal of the wireless module 700 from the first pocket 404.

Figure 8:
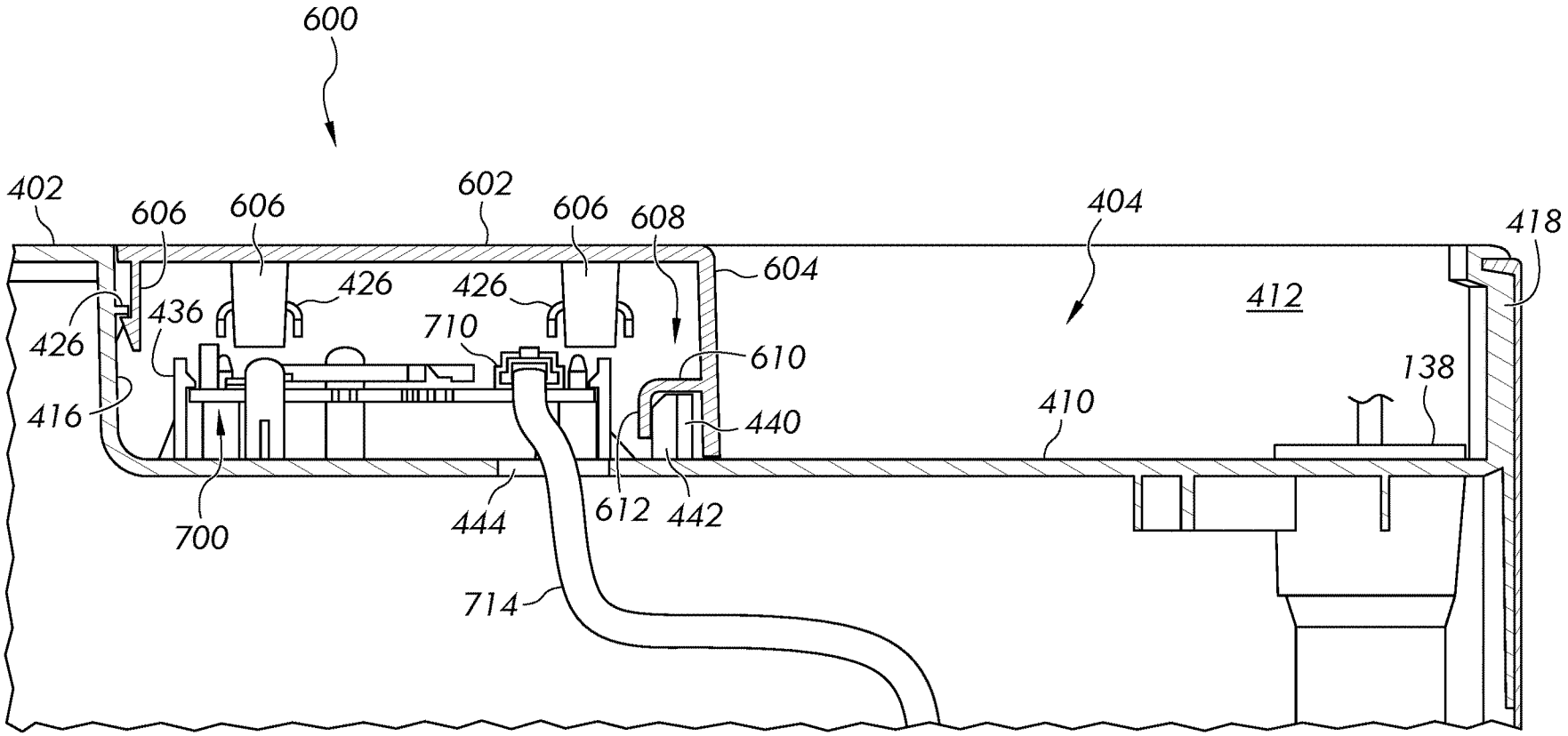
FIG. 8 is a schematic, cross-sectional view of the top end cap (in an assembled state)

Next, with respect to FIG. 8, the electronic connector 710 of the wireless module 700 is connected to an electrical wire 714 in order to power the wireless module 700. Specifically, one end of the electrical wire 714 (not shown) is connected to an electrical component (e.g., a main control board of the refrigerator 100) and the electrical wire 714 is routed from the cabinet 110, through a bushing 138 installed within the hinge-hole 424, through the access hole 444 formed in the bottom wall 410 of the first pocket 404, and to the electronic connector 710.

Figure 9:
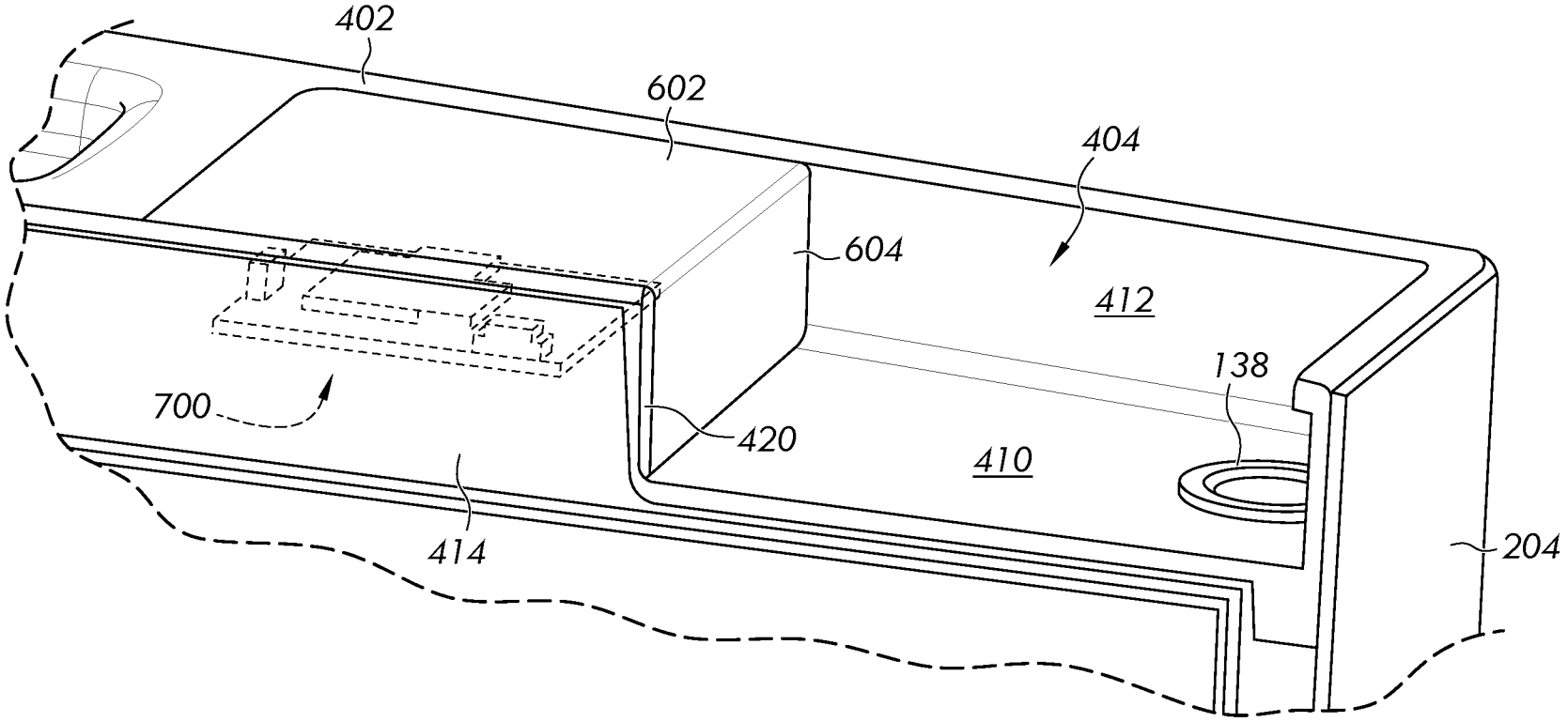
FIG. 9 is a perspective view of the cover secured to the top endcap.

Thereafter, the cover 600 is installed within the first pocket 404 in a covering manner with respect to the wireless module 700 (as depicted in FIG. 9). This is accomplished by positioning the cover 600 above the installed, wireless module 700 and orienting the cover 600 such that its side wall 604 is spaced from and opposedly faces the third side wall 416 of the first pocket 404. Thereafter, the cover 600 is translated (vertically downwards) into its installed position, wherein the claw 608 partially surrounds the securing member 438 and wherein each securing clip 606 of the cover 600 mates with a corresponding one of the tabs 426 in a snap-fit manner. More specifically, in the installed position, the first leg 610 of the claw 608 is disposed above both the upstanding wall 440 and the fins 442 of the securing member 438 and the second leg 612 is disposed adjacent the fins 442 of the securing member 438. Accordingly, the engagement between the claw 608 of the cover 600 and the securing member 438 provides an anchoring point for the cover 600 such that it cannot shift laterally (i.e., towards the fourth wall 418 of the first pocket 404), thereby permitting the securing clips 606 to engage their corresponding tabs 426 in the snap-fit manner to secure the cover 600 to the first endcap 400.

As shown in FIG. 9, due to the relative dimensions of the depth of the first pocket 404 (i.e., distance D2) and the length of the side wall 604 (i.e., distance D4) being equal, the top wall 602 of the cover 600 sits flush (i.e., coplanar) with the top wall 402 of the first endcap 400, when the cover 600 is correctly assembled. Similarly, because the length of the second wall 414 (i.e., distance D1) of the first pocket 404 is equal to the length of the top wall 602 (i.e., distance D3) of the cover 600, the side wall 604 of the cover 600 sits flush (i.e., coplanar) with the edge 420 of the second wall 414. Accordingly, the relative dimensions of the cover 600 and of the first pocket 404 permit the cover 600 to be installed in a manner that is not overly obtrusive with respect to a total area of the first pocket 404. In this manner, sufficient space remains to ensure proper assembly of the hinge 409 (shown in FIG. 2) within the first pocket 404 and its operation (i.e., permitting the fresh-food compartment door 108 to pivot with respect to the cabinet 110).

Thereafter, the remaining parts of the fresh-food compartment door 108 are assembled. For example, with respect to FIGS. 1-2, the dispenser 116 is assembled with respect to the through-hole 210 in the front panel 202, and the inner liner 300 is secured to the outer skin 200. Moreover, a foam agent may be blown into the space defined between the outer skin 200 and the inner liner 300 to thermally insulate the fresh-food compartment door 108.

The above-noted design of the first endcap 400 and the placement of the wireless module 700 therein provides several technical advantages. Initially, as discussed above, the first endcap 400 is manufactured from plastic. Accordingly, the material of the first endcap 400 permits consistent connection between the wireless module 700 and the end user's (remote) mobile device, as opposed to other materials (e.g., metal) known to hinder wireless connectivity. Next, the wireless module 700 is provided within the first endcap 400, which is located adjacent a top-most wall of the cabinet 110. This placement helps to ensure that the wireless module 700 will not be unduly obstructed (from above) when installed at a location selected by the end user. That is, as the fresh-food compartment doors 108 of the refrigerator 100 are often left unobstructed (from above) in order to permit proper pivoting thereof, there is a higher probability of the wireless module 700 not being overly obstructed. Further still, the wireless module 700 is spaced from the bottom wall 410 of the first pocket 404 (via the respective bases 430 of the locating pins 428) and is arranged such that the antenna 708 faces upwards (i.e., a direction opposite to and away from the bottom wall 410 of the first pocket 404), which ensures proper spacing and orientation of the antenna 708 for allowing maximum range connectivity. Also, the cover 600 both conceals and protects the wireless module 700 from accidental damage, while also permitting quick access thereto for servicing. Of note, other electronics can likewise benefit from these advantages provided by the above-described placement/arrangement. For example, temperature and/or humidity sensors (not shown) can be disposed within the first pocket 404 and covered by the cover 600. Again, such placement would both protect the sensor(s) from accidental damage, dust and/or debris, while also providing an easy access point for servicing/repair.

Figure 10:
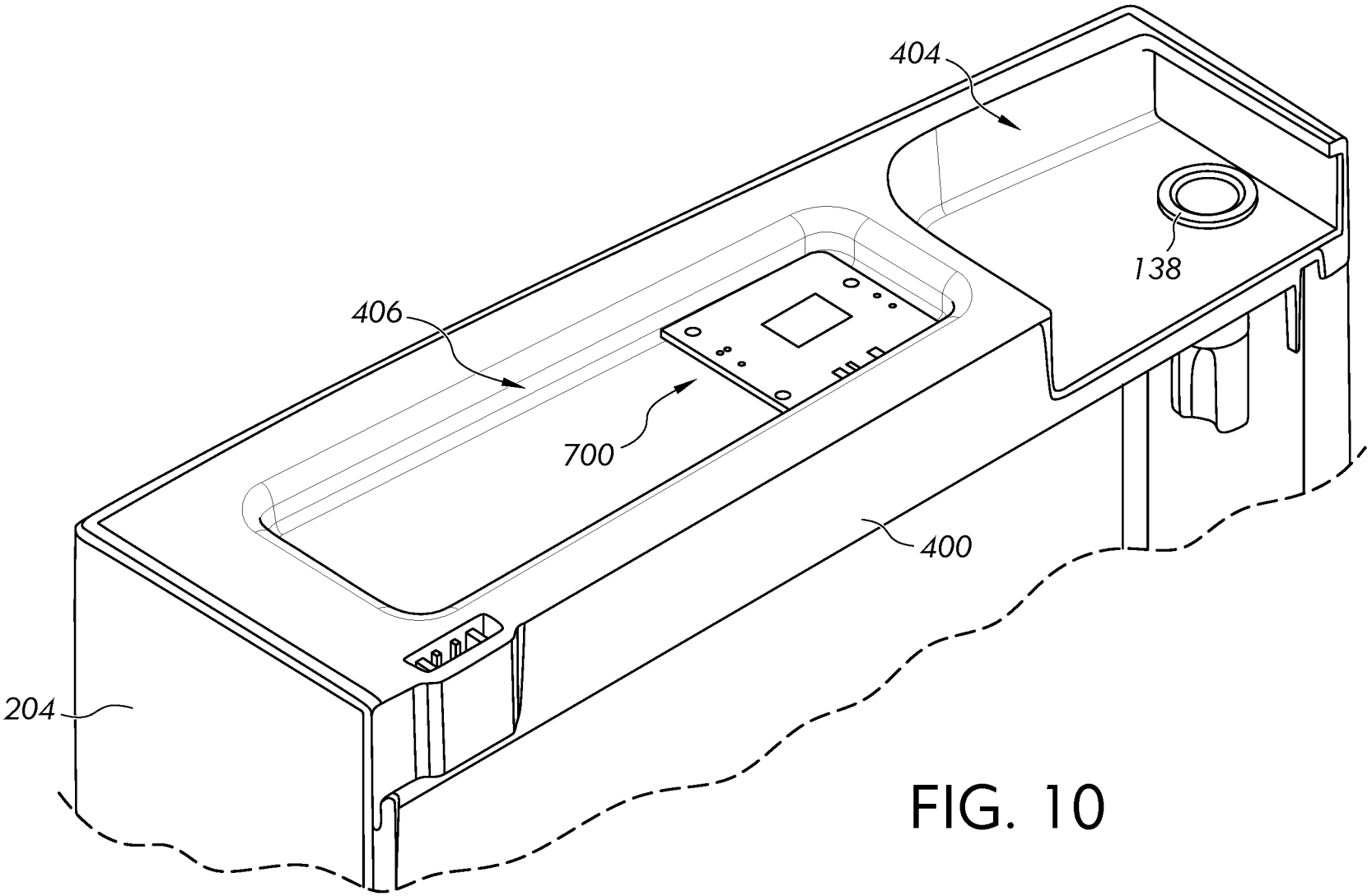
FIG. 10 is a perspective view of a separate example embodiment of a top endcap.

The above-noted advantages are not solely directed to the wireless module 700 being located within the first pocket 404 of the first endcap 400. For example, with respect to FIG. 10, an alternative embodiment is shown wherein the wireless module 700 is disposed within the second pocket 406 of the first endcap 404 (with the cover 600 removed). This placement likewise provides the above-noted technical advantages that ensure proper and maximum range connectivity.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A refrigerator appliance door comprising:

an outer skin extending between first and second distal edges thereof, the outer skin forming an external appearance of the refrigerator appliance door;

an inner liner disposed adjacent the outer skin such that a space is formed therebetween;

a first endcap disposed at the first distal edge of the outer skin, the first endcap partially enclosing the space formed between the outer skin and the inner liner; and a wireless module configured to wirelessly communicate with a mobile device, the wireless module being positioned on the first endcap, wherein the first endcap has a first pocket recessed from a top wall thereof, the first pocket being defined by a bottom wall, opposite first and second walls that are spaced apart from one another by opposite third and fourth walls, wherein the wireless module is received within the first pocket, and wherein a gap is formed between an edge of the second wall and the fourth wall, the gap being configured to permit a hinge entry into the first pocket in order to engage a hinge-hole formed in the bottom wall of the first pocket.

2. The refrigerator appliance door of claim 1, further comprising a second endcap disposed adjacent the second distal edge of the outer skin such that the first and second endcaps collectively enclose the space formed between the outer skin and the inner liner.

3. The refrigerator appliance door of claim 1, the first endcap further comprising a second pocket recessed from the top wall of the first endcap, wherein the first and second pockets are spaced from one another by a boundary and are arranged side-by-side with respect to a longitudinal direction of the first endcap.

4. The refrigerator appliance door of claim 1, wherein a locating pin extends from the bottom wall and includes a base and a shaft, wherein the shaft extends through a locating hole formed in the wireless module and the wireless module rests on a ledge of the base.

5. The refrigerator appliance door of claim 4, wherein a retention clip extends from the bottom wall and removably secures the wireless module within the first pocket, wherein a distal end of the retention clip is resiliently movable.

6. The refrigerator appliance door of claim 5, the wireless module comprising a printed circuit board having opposite first and second surfaces, and an antenna disposed on the first surface of the printed circuit board, wherein the second surface of the printed circuit board rests on the ledge of the base, and wherein the distal end of the retention clip contacts the first surface of the printed circuit board.

7. The refrigerator appliance door of claim 1, further comprising a cover received within the first pocket and arranged to conceal the wireless module, wherein the cover comprises a top wall that is coplanar with the top wall of the first endcap.

8. The refrigerator appliance door of claim 7, the cover having a securing clip extending outwards from the top wall thereof, wherein the securing clip is configured to engage with a corresponding tab protruding from one of the first, second, or third walls of the first pocket in order to secure the cover to the first endcap.

9. The refrigerator appliance door of claim 1, the first endcap being plastic, and the wireless module comprising an antenna disposed on a surface of a printed circuit board, wherein the surface of the printed circuit board faces outwards and away from the first endcap.

10. An appliance comprising:

a cabinet defining a compartment for storing food items in a cooled environment; and a door pivotably attached to the cabinet to provide selective access to the compartment, the door comprising:

an endcap disposed adjacent a top wall of the cabinet when the door is in a closed position, the endcap having a first pocket recessed from a top wall thereof, the first pocket being defined by a bottom wall, opposite first and second walls that are spaced apart from one another by opposite third and fourth walls; and a wireless module configured to wirelessly communicate with a mobile device, the wireless module being received within the first pocket and including a printed circuit board and an antenna, the antenna facing outwards and away from the endcap, wherein a gap is formed between an edge of the second wall and the fourth wall, the gap being configured to permit a hinge entry into the first pocket in order to engage a hinge-hole formed in the bottom wall of the first pocket.

11. The appliance of claim 10, the door further including a removable cover disposed within the first pocket and concealing the wireless module, the cover having a top wall and a side wall, wherein the top wall of the cover is coplanar with the top wall of the endcap, and wherein the side wall of the cover sits flush with the edge of the second wall.

12. The appliance of claim 10, the printed circuit board including opposite first and second surfaces, the antenna being disposed on the first surface of the printed circuit board, wherein a plurality of locating pins extend outwards from the bottom wall of the first pocket, each of the plurality of locating pins having a stem extending through a corresponding locating hole formed in the printed circuit board, and wherein the second surface of the printed circuit board faces the bottom wall of the first pocket and rests on respective ledges of the plurality of locating pins.

13. The appliance of claim 10, wherein a plurality of retention clips extend outwards from the bottom wall and are spaced from one another about a periphery of the printed circuit board, the plurality of retention clips being configured to secure the wireless module within the first pocket.

14. The appliance of claim 10, the endcap having a second pocket recessed from the top wall thereof and spaced apart from the first pocket by a boundary.

15. The appliance of claim 10, the door further comprising an outer skin including a front panel and a pair of side panels extending perpendicularly from the front panel, and an inner liner disposed adjacent the outer skin and spaced from the front panel thereof by the pair of side panels such that an internal space is defined therebetween, wherein the endcap is made of plastic, and wherein the endcap encloses the internal space.

16. A refrigerator appliance door pivotably attached to a cabinet of a refrigerator appliance to provide selective access to a compartment thereof, the refrigerator appliance door comprising:

an outer skin extending between first and second distal edges thereof, the outer skin forming an external appearance of the refrigerator appliance door, and the first distal edge of the outer skin being disposed adjacent a top wall of the cabinet when the refrigerator appliance door is in a closed position;

an inner liner disposed adjacent the outer skin such that a space is formed therebetween;

a first endcap disposed at the first distal edge of the outer skin, the first endcap being made of plastic and comprising first and second pockets, each recessed from a top wall of the first endcap, wherein the first and second pockets are spaced from one another by a boundary and are arranged side-by-side with respect to a longitudinal direction of the first endcap, wherein the first pocket is defined by a bottom wall, opposite first and second walls that are spaced apart from one another by opposite third and fourth walls, wherein a locating pin extends from the bottom wall and includes a base and a shaft, wherein a retention clip extends from the bottom wall and includes a distal end that is resiliently movable, and wherein a gap is formed between an edge of the second wall and the fourth wall, the gap being configured to permit a hinge entry into the first pocket in order to engage a hinge-hole formed in the bottom wall of the first pocket;

a second endcap disposed at the second distal edge of the outer skin, the second endcap being made of plastic, and the first and second endcaps collectively enclosing the space formed between the outer skin and the inner liner;

a wireless module configured to wirelessly communicate with a mobile device, the wireless module comprising a printed circuit board having opposite first and second surfaces, and an antenna disposed on the first surface of the printed circuit board, wherein the wireless module is received within the first pocket such that the second surface of the printed circuit board rests on a ledge of the base, wherein the shaft extends through a locating hole formed in the printed circuit board, and wherein the distal end of the retention clip contacts the first surface of the printed circuit board; and a cover received within the first pocket and arranged to conceal the wireless module, wherein the cover comprises a top wall that is coplanar with the top wall of the first endcap, wherein the cover has a securing clip extending outwards from the top wall thereof, wherein the securing clip is configured to engage with a corresponding tab protruding from one of the first, second, or third walls of the first pocket in order to secure the cover to the first endcap.

* * * * *